United States Patent [19]

Cayton

[11] 4,452,450

[45] Jun. 5, 1984

[54] SEVEN BALLS AND BILLIARD RACK THEREFOR

[76] Inventor: William D. Cayton, 25 Myrtle Blvd., Larchmont, N.Y. 10538

[21] Appl. No.: 282,792

[22] Filed: Jul. 13, 1981

[51] Int. Cl.[3] ..... A63D 15/00

[52] U.S. Cl. ..... 273/22

[58] Field of Search ..... D21/206, 232; 273/2, 273/10, 11 R, 11 C, 14, 22

[56] References Cited

U.S. PATENT DOCUMENTS

| | | | |
|---|---|---|---|
| 526,554 | 9/1894 | Barnes | 273/14 |
| 854,799 | 5/1907 | Callahan | 273/22 |
| 2,060,495 | 11/1936 | Giragosian | 273/22 |
| 2,219,675 | 10/1940 | Gillespie | 273/22 |
| 4,005,861 | 2/1977 | Tomczak | 273/22 |
| 4,183,523 | 1/1980 | Hecht | 273/22 |
| 4,307,881 | 12/1981 | Jaworski | 273/22 |

FOREIGN PATENT DOCUMENTS

| | | | |
|---|---|---|---|
| 1502725 | 3/1978 | United Kingdom | 273/22 |

*Primary Examiner*—Richard T. Stouffer
*Assistant Examiner*—William H. Honaker
*Attorney, Agent, or Firm*—Gottlieb, Rackman & Reisman

[57] ABSTRACT

An improved pocket billiard rack configured to facilitate the circular arrangement of seven billiard balls on a billiard table. The rack includes a framing member having circular opening therethrough disposed between a top end and a bottom end. The framing member is dimensioned for receiving seven billiard balls in abutting relation positioned in a circular arrangement. The rack facilitates play in a novel "Seven Ball" billiard game, which permits players to perform combination and carom shots, defensive shots and placement in a fast-paced game.

11 Claims, 4 Drawing Figures

SEVEN BALLS AND BILLIARD RACK THEREFOR

BACKGROUND OF THE INVENTION

The present invention relates to a billiard ball rack and more specifically, a billiard rack for employment in conjunction with a new and novel "Seven Ball" billiard game played with seven billiard balls.

In recent years there has been a resurgence in the popularity of pocket billiards. This renewed interest has paralleled a growing nationwide fascination with fast-paced games of skill, intellect and strategy. Billiards has been recognized for the challenge and strategic complexity offered to players of all levels of experience.

Television has proved a particularly important medium for presenting competitive amateur and professional games to nationwide audiences. The popularity of "game" shows has focused the attention and interest of the television industry upon games suitable for the television viewing public.

Billiards has received increasing recognition by the television industry in the presentation of professional tournaments. The popularity of billiards for non-professional game shows, however, has been limited by the difficulty and level of expertise required for the game to proceed at a pace suitable for television audiences.

Developments in the electronic and computer game technologies have also presented the need for fast-paced challenging games of skill and strategy. As in the television arts, it is necessary for such games to be of short duration. A billiard game which incorporates the challenge and strategic aspects of traditional billiards, but which is fast paced and of short duration is likely to be well-received in the communication industries.

BRIEF SUMMARY OF THE INVENTION

The present invention provides an improved pocket billiard rack configured to facilitate the circular arrangement of seven billiard balls on a billiard table. This purpose is achieved generally by a design which takes advantage of the geometric principle that six spherical balls surrounding a seventh spherical ball will define a circular circumference. In the preferred embodiment, the rack includes a framing member having a generally circular opening therethrough disposed between a top end and a bottom end. The framing member is dimensioned for closely receiving seven billiard balls in abutting relation positioned in a circular arrangement.

In an alternative embodiment, the billiard ball rack of this invention is provided with a generally hexagonal opening between its top and bottom ends. The rack of this embodiment is similarly dimensioned for closely receiving seven billiard balls in abutting and circular arrangement.

The billiard rack of the present invention is illustratively useful to facilitate play in a novel "Seven Ball" billiard game played with a cue ball and seven object balls numbered one through seven. The balls numbered 1–6 are racked in a clockwise circle on the footspot of the billiard table with the "1" ball at the apex, and the "7" ball in the middle of the circle. Generally, the object of the game is to pocket billiard balls numbered "1"–"6" in numerical order in any pocket on the table. Thereafter, the "7" ball must be pocketed in a designated side pocket of the table. This "Seven Ball" billiard game permits players to perform combination and carom shots, defensive shots, and placement in a fast-paced game of short duration.

Other objects, aspects, features and advantages of the present invention will be apparent when the detailed description of the preferred embodiment of the invention is considered in conjunction with the drawings, which should be construed in an illustrative and not a limiting sense, as follows:

DESCRIPTION OF THE PREFERRED EMBODIMENTS

Figure 1:
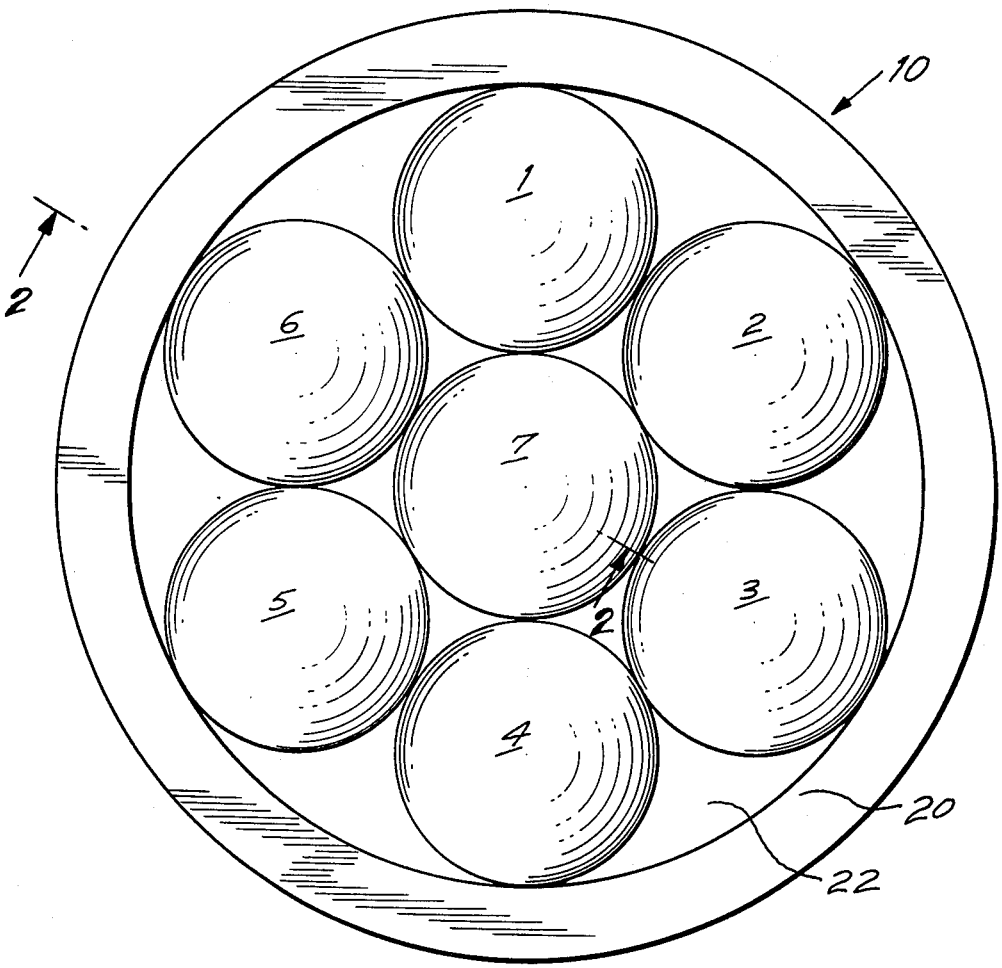
FIG. 1 is a top plan view of an embodiment of the billiard rack of this invention filled with seven billiard balls.
Figure 2:
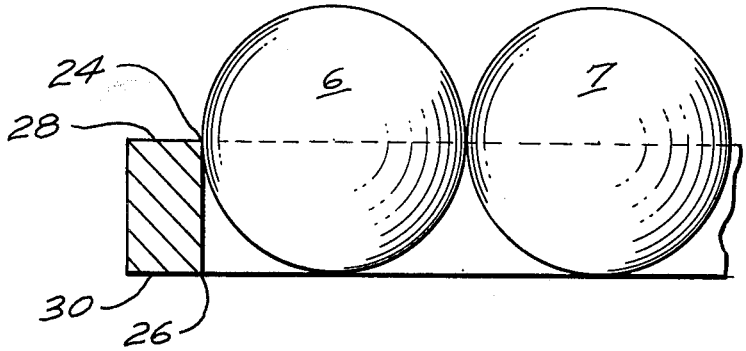
FIG. 2 is a partial cross-sectional view, taken along the line 2—2 of FIG. 1.

Referring to FIGS. 1 and 2, a billiard rack constructed in accordance with this invention is illustrated, filled with seven billiard balls numbered 1–7. The billiard rack 10 is configured to facilitate the circular arrangement of seven billiard balls on a billiard table. This purpose is achieved generally by a design which takes advantage of the geometric principle that six spherical balls surrounding a seventh spherical ball will define a circular circumference.

In the preferred embodiment, the rack includes a framing member 20 having a generally circular opening 22 therethrough disposed between a top end 24 and bottom end 26. The billiard rack 10 is provided with planar top and bottom surfaces 28 and 30 to facilitate positioning of the billard rack on a billiard table. The framing member 20 is dimensioned for closely receiving seven billiard balls in abutting relation positioned in a circular arrangement.

In accordance with the preferred embodiment, the billiard rack 10 is fabricated, molded or injection molded of a resilient plastic. It should be understood, however, that the billiard rack 10 may be fabricated of other suitable materials such as for example, wood or metal.

Figure 3:
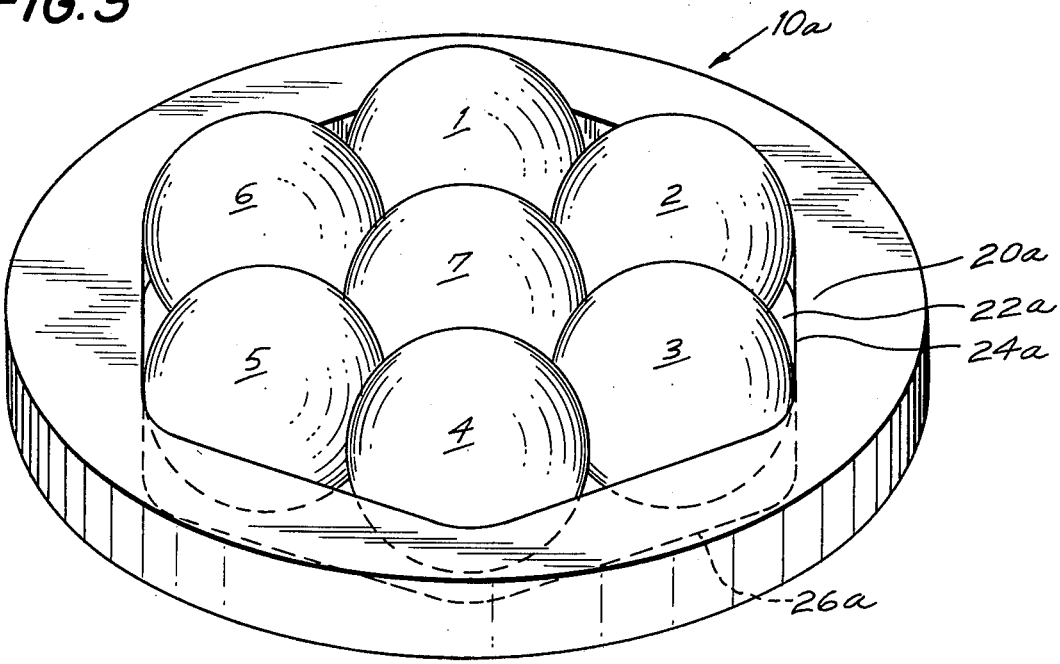
FIG. 3 is a perspective view of an alternative embodiment of the billiard rack of this invention filled with seven billiard balls.

An alternative embodiment of the billiard rack of this invention is illustrated in FIG. 3. In this embodiment, the billiard rack 10*a* is provided with a framing member 20*a* having a generally hexagonal opening 22*a* from a top end 24*a* to a bottom end 26*a*. The rack of this embodiment is also dimensioned for closely receiving seven billiard balls in abutting and circular arrangement.

Figure 4:
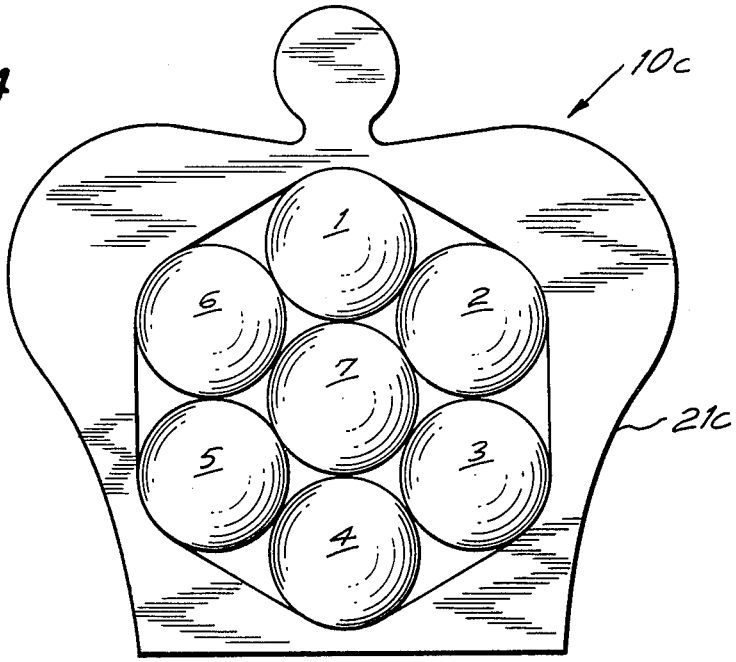
FIG. 4 is a top plan view of an embodiment of rack of this invention similar to FIG. 3 incorporating an exterior wall design.

Referring to FIG. 4, there is illustrated a billiard rack 10*c* similar to FIG. 3, except that the rack includes an exterior wall surface 21*c* having an identifiable "crown" design symmetry. This design symmetry facilitates the selective placement of the billiard balls in a predetermined numerical sequence and orientation on the billiard table. It will be appreciated by those skilled in the art that the billiard balls may also be positioned by employment of directional markings on the billiard rack.

The exterior wall design of FIG. 4 is illustrative of the manner in which external design features may be incorporated into the rack. It should be appreciated that a variety of trademark logos may be incorporated into the billiard rack of this invention. Association of the billiard rack and the "Seven Ball" game with such trademarks provides a useful advertising medium.

The billiard rack of the present invention is designed for use as part of a new "Seven Ball" billiard game. "Seven Ball" is a fast-paced game played in rotation and designed to meet the time requirements of television and the electronic game arts, as well as the home market. The unique arrangement of the object balls provided by the present invention permits players of all levels of experience to perform combination and carom shots, defensive shots and placement in a game of short duration.

"Seven Ball" is designed for two players or teams. The game is played with a cue ball and seven object balls numbered "1" through "7". The object of the game is to pocket the "7" ball in a designated pocket in accordance with game rules which are set forth below.

PREPARATION FOR PLAY

Seven balls number "1"–"7" are racked on the footspot of a conventional billiard table in the specially designed rack of the present invention. The balls numbered "1"–"6" are arranged in a clockwise circle in numerical sequence, with the "1" ball at the apex of the circle. The "7" ball is positioned in the middle of the circle.

OPENING BREAK

The starting player must cause the cue ball's first contact to be with the "1" ball and either (A) make an open break, or (B) legally pocket an object ball. If he fails to do so, the following player has the choice of either reracking the balls and shooting the opening break shot himself, or being provided with the cue ball in hand behind the head string.

After a legal opening break, the opponent has a choice of which side of the table (any of the three pockets on one side) into which he will attempt to pocket the "7" ball. Balls "1"–"6" may be pocketed on either side of the table. Players of unequal ability may be assigned different numbers of pockets into which they can play the "7" ball.

RULES OF PLAY

The rules which may be employed to play the "Seven Ball" game with the present invention are:

1. A legal shot requires that the cue ball's first contact be with the lowest numbered ball on the table. A player must then pocket a ball, or cause the cue ball or any object ball to contact a cushion. Failure to meet these requirements is a foul. As a penalty, the next player is provided with the cue ball in hand for placement anywhere on the billiard table.

2. A legally pocketed ball entitles a shooter to remain at the table until he fails to pocket a ball on a legal shot.

3. Illegally pocketed object balls are spotted with the lowest numerical ball first. As a penalty, the incoming player is provided with the cue ball in hand for placement anywhere on the billiard table.

4. Jumped object balls are also spotted in numerical order; however, the player remains at the table if he has pocketed his legal object ball.

5. The general rules of pocket billiards apply unless contradicted by these rules. As a penalty for a violation of the general rules, the succeeding player is provided with the cue ball in hand for placement anywhere on the billiard table.

GAME WIN

The player legally pocketing the "7" ball in an assigned pocket is credited with a game win. The balls have no assigned point values. The "7" ball may be pocketed out of rotational order, to win the game, but only if the cue ball first contacts the lowest numbered object ball still left on the table. Pocketing the "7" ball on the break wins the game, if no foul has been committed at the same time; however, it should be appreciated that the "7" ball is contained within an outer ring of the other six balls, so that directing the "7" ball intentionally towards a pocket will be an extremely difficult feat.

LOSS OF GAME

A player loses the game if he commits any of the following infractions: (a) pockets the "7" ball in a nonassigned pocket; (b) "scratches" (i.e., pockets the cue ball) when the "7" ball is his legal object ball; (c) pockets the "7" ball on an illegal shot; (d) fails to complete a legal shot when the "7" ball is his object ball; or (e) fouls in three consecutive turns at the table.

Advantageously, the billiard rack of this invention may be adapted for employment in electronic and computer style games. In conjunction with the "Seven Ball" game, the billiard rack provides a challenging and strategic fast-paced game suitable for the electronic game arts.

It should be understood by those skilled in the art that various modifications may be made in the present invention without departing from the spirit and scope thereof as described in the specification and in the appended claims.

What I claim is:

1. The combination of a pocket billiard rack configured to facilitate the circular arrangement of seven billiard balls on a billiard table, and seven billiard balls, comprising a framing member having a top end, a bottom end and an opening extending between said ends, said framing member being dimensioned for closely receiving said balls in a circular arrangement, said member being so dimensioned such that it would constrain six of said balls to surround and abut the seventh of said balls when each of the balls and rack are resting on the billiard table.

2. A pocket billiard rack as in claim 1 wherein the opening is generally hexagonal in configuration.

3. A pocket billiard rack as in claim 2 wherein said framing member includes means for selectively positioning said balls in a numerically sequential arrangement.

4. A pocket billiard rack as in claim 3 wherein said positioning means comprises an exterior wall surface having an identifiable design symmetry for facilitating the selective placement of said balls in a predetermined sequence and orientation on the billiard table.

5. A pocket billiard rack as in claim 4 dimensioned to overlie a portion of the billiard table.

6. A pocket billiard rack as in claim 5 fabricated out of plastic.

7. A pocket billiard rack as in claim 1 wherein the opening is generally circular in configuration.

8. A pocket billiard rack as in claim 7 wherein said framing member includes means for selectively positioning said balls in a numerically sequential arrangement.

9. A pocket billiard rack as in claim 8 wherein said positioning means comprises an exterior wall surface having an identifiable design symmetry for facilitating the selective placement of said balls in a predetermined sequence and orientation on the billiard table.

10. A pocket billiard rack as in claim 9 dimensioned to overlie a portion of the billiard table.

11. A pocket billiard rack as in claim 10 fabricated out of plastic.

* * * * *